US006096147A

United States Patent [19]

Taylor et al.

[11] Patent Number: 6,096,147

[45] Date of Patent: Aug. 1, 2000

[54] IGNITION ENHANCED GAS GENERANT AND METHOD

[75] Inventors: Robert D. Taylor, Hyrum; Ivan V. Mendenhall, Providence, both of Utah; Gary K. Lund, Malad, Id.

[73] Assignees: Autoliv ASP, Inc., Ogden; Cordant Technologies Inc., Salt Lake City, both of Utah

[21] Appl. No.: 09/126,467

[22] Filed: Jul. 30, 1998

[51] Int. Cl.[7] ..... C06B 45/18

[52] U.S. Cl. ..... 149/3; 149/109.6

[58] Field of Search ..... 149/109.6, 5, 6, 149/7, 3; 427/201, 202, 180

[56] References Cited

U.S. PATENT DOCUMENTS

| | | | |
|---|---|---|---|
| 3,147,710 | 9/1964 | Gluckstein | 102/70 |
| 4,092,187 | 5/1978 | Hildebrant et al. | 149/11 |
| 4,179,327 | 12/1979 | Seldner | 156/667 |
| 4,244,758 | 1/1981 | Garner et al. | 149/7 |
| 4,246,051 | 1/1981 | Garner et al. | 149/7 |
| 4,354,884 | 10/1982 | Williams | 149/10 |
| 4,696,705 | 9/1987 | Hamilton | 149/21 |
| 4,698,107 | 10/1987 | Goetz et al. | 149/7 |
| 4,806,180 | 2/1989 | Goetz et al. | 149/5 |
| 4,858,951 | 8/1989 | Lenzen | 280/741 |
| 4,994,212 | 2/1991 | Vos et al. | 264/3.3 |
| 5,034,070 | 7/1991 | Goetz et al. | 149/3 |
| 5,051,143 | 9/1991 | Goetz | 149/3 |
| 5,125,684 | 6/1992 | Cartwright | 280/736 |
| 5,441,705 | 8/1995 | Lauritzen et al. | 422/166 |
| 5,494,312 | 2/1996 | Rink | 280/737 |
| 5,507,890 | 4/1996 | Swann et al. | 149/16 |
| 5,592,812 | 1/1997 | Hinshaw et al. | 60/205 |
| 5,608,183 | 3/1997 | Barnes et al. | 149/45 |
| 5,620,205 | 4/1997 | Lauritzen et al. | 280/741 |
| 5,669,629 | 9/1997 | Rink | 280/741 |
| 5,672,843 | 9/1997 | Evans et al. | 102/289 |
| 5,673,935 | 10/1997 | Hinshaw et al. | 280/741 |
| 5,725,699 | 3/1998 | Hinshaw et al. | 149/19.1 |

*Primary Examiner*—Charles T. Jordan
*Assistant Examiner*—Aileen J. Baker
*Attorney, Agent, or Firm*—Pauley Petersen Kinne & Fejer

[57] ABSTRACT

An ignition enhanced gas generant grain and method of making an ignition enhanced gas generant involving the application of a dry blend igniter composition to a gas generant particle having a wet adhesive surface.

8 Claims, 1 Drawing Sheet

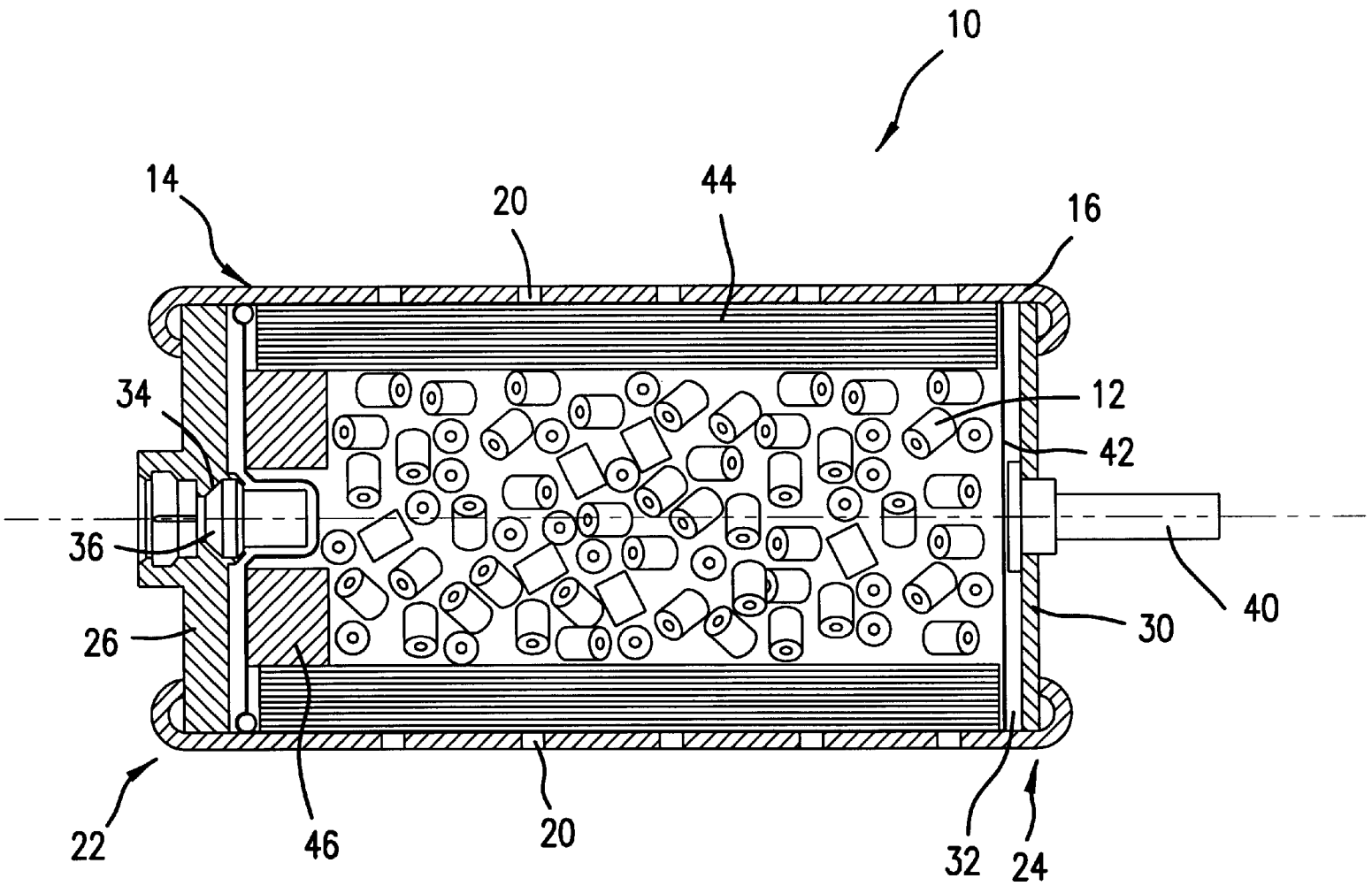
FIGURE

IGNITION ENHANCED GAS GENERANT AND METHOD

BACKGROUND OF THE INVENTION

This invention relates generally to gas generating materials such as used in the inflation of inflatable devices such as inflatable vehicle occupant restraint airbag cushions and, more particularly, to ignition enhanced gas generating materials.

It is well known to protect a vehicle occupant using a cushion or bag, e.g., an "airbag cushion," that is inflated or expanded with gas when the vehicle encounters sudden deceleration, such as in the event of a collision. In such systems, the airbag cushion is normally housed in an uninflated and folded condition to minimize space requirements. Upon actuation of the system, the cushion begins to be inflated, in a matter of no more than a few milliseconds, with gas produced or supplied by a device commonly referred to as "an inflator."

Many types of inflator devices have been disclosed in the art for use in the inflating of one or more inflatable restraint system airbag cushions. Many prior art inflator devices include solid form gas generant materials which are burned to produce or form gas used in the inflation of an associated airbag cushion.

Such inflator devices tend to involve rather complex ignition processes. For example, it is relatively common to employ an electrically initiated squib to ignite a separate charge of an igniter composition. The products of such ignition are then used to ignite the gas generant material. In practice, the ignition process of many various prior inflator devices require such a separate igniter charge because the squib does not itself generally supply sufficient hot gas, condensed phase particles or other ignition products to heat the gas generant material to result in the reaction of the material such as to result in desired gas generation.

As is known, a common means of obtaining substantially simultaneously ignition of an extended length charge of an igniter composition, is by means of an ignition cord. In practice, it is common that such length of ignitor cord be housed or contained within an igniter tube extending within such an igniter charge.

While ignition of the gas generant material may ultimately be achieved through the use of such an igniter charge, such use typically tends to undesirably complicate the ignition process as well as the manufacture, production and design of the associated inflator device. For example, such use necessitates that an igniter composition be manufactured or made and then subsequently handled such as through manufacture of a desired form of container to hold or store the igniter composition for subsequent incorporation into the inflator device design as a part of an igniter assembly.

In addition, the use of such an ignition process can detrimentally impact either or both the weight and cost of the corresponding apparatus hardware. For example, the incorporation and use of such an igniter tube and ignition cord will typically increase both the weight and cost associated with a corresponding assembly.

As will be appreciated, space is often at a premium in modem vehicle design. Consequently, it is generally desired that the space requirements for various vehicular components, including inflatable vehicle occupant restraint systems, be reduced or minimized to as great an extent as possible. The incorporation of an igniter assembly such as described above and associated support structure, may require a larger than desired volume of space within an associated inflator device. In particular, such volume of space could potentially be utilized to store or contain gas generant material and thereby permit the volume of space required by the inflator device to be reduced.

Thus, there is a need and a demand for alternative airbag inflator device ignition schemes and, in particular, there is a need and a demand for avoiding the requirement or inclusion of separate igniter composition charges. Various patents, including U.S. Pat. Nos. 4,698,107; 4,806,180; and 5,034,070, disclose processing wherein an ignition coating is applied, such as in the form of a liquid or a water slurry, to azide-based gas generant materials. Such processing typically necessitates first the formation of the azide-based gas generant, including the proper forming and drying of gas generant grains in selected shapes, followed by the coating of the grain with a wet slurry of the ignition material and then final drying.

As will be appreciated, such processing may involve a greater than desired number of processing steps and associated processing hardware. Thus, there is a need and a demand for a simplified processing technique such as avoids the requirement or inclusion of a separate igniter composition charge.

An oftentimes key performance characteristic of an inflatable restraint system inflator device is termed, "ignition delay," i.e., the period of time between when the system, e.g., the inflator, is first initiated and when the system first produces a measurable pressure output. In inflatable restraint systems, it is generally desirable to control and, if possible, minimize such ignition delays.

Unfortunately, the above-described slurry-formed ignition coated gas generants may experience undesirably lengthened or extended ignition delays upon actuation. Thus, there is a need and a demand for processing and a gas generant such that the gas generant may provide improved performance, such as significantly reduced ignition delays, for example.

SUMMARY OF THE INVENTION

A general object of the invention is to provide an improved gas generating material such as used in the inflation of inflatable devices such as an inflatable vehicle occupant restraint airbag cushions.

A more specific objective of the invention is to overcome one or more of the problems described above.

The general object of the invention can be attained, at least in part, through a method of making an ignition enhanced gas generant which includes a step of applying a dry blend igniter composition to a gas generant particle having a wet adhesive surface to form an ignition enhanced gas generant grain.

The prior art fails to provide an as simple as may be desired processing technique and such as avoids the requirement or inclusion of a separate igniter composition charge. Further, the prior art fails to provide a processing technique and a gas generant such that the gas generant may provide as greatly improved performance, such as through reduced ignition delays, for example, as may be desired.

The invention further comprehends a method of making an ignition enhanced gas generant which method includes the step of solvent extruding a gas generant material containing a solvent soluble binder to form a gas generant particle having a solvent wet adhesive surface. The solvent wet adhesive surface of the gas generant particle is then coated with a dry blend igniter composition. The igniter coated gas generant particle is then dried to form an ignition enhanced gas generant grain.

The invention still further comprehends particular ignition enhanced gas generant grains. In accordance with one embodiment of the invention, such an ignition enhanced gas generant grain is of a gas generant particle having a wet adhesive surface onto which surface is applied a dry blend igniter composition to form a coating with the coated particles finally dried to form the ignition enhanced gas generant grain.

An ignition enhanced gas generant grain, in accordance with another embodiment of the invention, constitutes a particle of a gas generant composition coated with an igniter composition. The gas generant composition particles include about 2% to about 15% by weight of a solvent soluble binder. This binder, prior to final drying, forms a solvent wet adhesive surface on the particle and onto which surface is applied a coating of a dry blend igniter composition. The igniter composition contains about 15% to about 40% by weight fuel and about 60% to about 85% by weight oxidizer and which igniter composition has a combustion temperature greater than about 2500 K. The ignition enhanced gas generant grain contains about 3% to about 25% by weight of the igniter composition and about 75% to about 97% by weight of the gas generant composition.

The solvent soluble binder may be water soluble. Such water soluble binder may be selected from the group consisting of naturally occurring and microbial produced gums (for example, guar, tragacanth, xanthin and acacia), polyacrylamide, polyacrylic acid and salts, copolymers of polyacrylamide and polyacrylic acid, polyvinyl alcohol, hydroxypropyl cellulose, methyl cellulose, hydroxyethyl cellulose and polyvinyl pyrrolidone.

Alternatively, the solvent soluble binder may not be water soluble. Such binder can be selected from the group consisting of ethyl cellulose, carboxymethyl cellulose, cellulose acetate butyrate, cellulose acetate, and other substituted cellulose derivatives.

In addition, the igniter composition of such ignition enhanced gas generant grain includes:

a) at least one fuel selected from the group consisting of B, Si, Al, Ti, $TiH_2$, Zr, $ZrH_2$, guanidine nitrate, Mg, Mg/Al alloys and mixtures thereof and b) at least one oxidizer selected from the group consisting of alkali metal nitrates, chlorates and perchlorates; alkaline earth metal nitrates, chlorates and perchlorates; CuO; $Fe_2O_3$; CoO; $Co_3O_4$; $V_2O_5$; ammonium nitrate; ammonium perchlorate; basic copper nitrate and mixtures thereof.

Unless otherwise specifically noted, percentages used herein are in terms of weight percent.

Other objects and advantages will be apparent to those skilled in the art from the following detailed description taken in conjunction with the appended claims and drawing.

BRIEF DESCRIPTION OF THE DRAWING

The FIGURE is a simplified, partially in section, schematic drawing of an airbag inflator assembly in accordance with one embodiment of the invention.

DETAILED DESCRIPTION OF THE INVENTION

The present invention provides an ignition enhanced gas generant grain as well as a method of making an ignition enhanced gas generant. The invention contemplates an ignition enhanced gas generant formed through the application of a dry blend igniter composition to a wet adhesive surface of a gas generant particle.

As identified above, the gas generant particles used in the practice of the invention desirably provide a wet adhesive surface. While such gas generant particles can be produced or formed using various techniques, the invention will be further described in relation to such gas generant particles produced or formed via solvent extrusion processing. It will be understood, however, that other manufacturing or production techniques such as form or otherwise include an intermediate step in which is formed a solvent wet generant particle having an adhesive surface can, if desired, be used.

In accordance with a preferred embodiment of the invention, such solvent extruded gas generant materials, in addition to at least one fuel material and at least one oxidizer material, contain a solvent soluble binder processing aid. As will be appreciated the inclusion of a binder may be needed or desired to permit or facilitate the wet processing, e.g., extrusion processing, of the fuel and oxidizer combination included in the pyrotechnic material.

The gas generant material composition is preferably extruded as a homogeneous mixture in a preselected shape to form a gas generant particle. As will be appreciated, variously sized and shaped gas generant particles can be used in accordance with the teachings of the invention. For example, such gas generant particles can take the form of right circular cylinders, spheres, granules and tablets, of selected dimensions and such as may include perforations, holes or other form of void or opening, as may be desired.

Prior to drying, the extruded gas generant particle desirably provides a solvent wet adhesive surface such as formed by the binder material. In the preferred practice of the invention, the binder component of the gas generant composition functions not only as a binder for the gas generation material but also as an adhesive to which igniter ingredients adhere such as to form an ignition enhanced gas generant in accordance with the invention.

As will be described in greater detail below, a selected igniter composition, such as formed by one or more fuel materials and one or more oxidizer materials, and such as in a selected or desired form, such as a dry blend thereof, is placed in contact with such solvent wet adhesive surface such that the igniter composition adheres to the surface of the extruded gas generant particles to form a coating thereon. The coated particles are then dried to form gas generant grains wherein the igniter composition is strongly attached to the gas generant material thus forming an ignition enhanced gas generant grain in accordance with one preferred embodiment of the invention. Such ignition enhanced gas generant grain desirably is in the form of a unitary single particle. In accordance with certain preferred embodiments of the invention, the interior of such ignition enhanced gas generant grain desirably is composed of gas generant composition components while the exterior portion of the grain, particularly the grain surface, is composed of a coating of the igniter composition.

Solvent soluble binders which desirably form or provide an adhesive surface or layer to wet processed gas generant particles and useful in the practice of the invention can be water soluble or soluble in a solvent other than water, i.e., not water soluble.

Useful water soluble binders include naturally occurring and microbial produced gums (for example, guar, tragacanth, xanthin and acacia), polyacrylamide, polyacrylic acid and salts, copolymers of polyacrylamide and polyacrylic acid, polyvinyl alcohol, hydroxypropyl cellulose, methyl cellulose, hydroxyethyl cellulose and polyvinyl pyrrolidone.

Useful binders which are soluble in solvents other than water include: ethyl cellulose, carboxymethyl cellulose, cellulose acetate butyrate, cellulose acetate, and other substituted cellulose derivatives.

In practice, gas generant particles of the invention preferably contain such water or other solvent soluble binders in a relative amount of about 2% to about 15% by weight.

Gas generant compositions useful in the practice of the invention can be commonly formed of conventional gas generant components including: fuel, oxidizer, solvent soluble binder and, if desired, various additives such as to either or both improve certain properties or facilitate processing.

As will be appreciated, a variety of materials can, as may be desired, be used as a fuel component in such gas generant compositions. Such fuel component materials include, for example: 5-amino tetrazole, biterazole and associated salts; metal aminotetrazole complexes; metal ammine nitrate complexes; azodicarbonamide; cyanamide salts; nitrotriazolone; barbituric acid; tartaric acid and associated salts; and triazole compounds, salts and complexes thereof.

The gas generant composition oxidizer component can desirably constitute one or more various materials including, for example: potassium, sodium, strontium, basic copper and ammonium nitrate; copper and iron oxide; potassium and ammonium perchlorate and mixtures thereof.

In addition, gas generant compositions in accordance with the invention may include various additives including, for example, processing aids, ballistic modifiers, antioxidants and opacifiers, such as are known in the art. For example, butylated hydroxy toluene derivatives can be used as antioxidants. Also, in accordance with the invention, one or more processing aid additives such as bentonite clay, alumina, silica, titanium dioxide, iron oxide and magnesium oxide may be included in the gas generant composition.

In accordance with a preferred embodiment of the invention, the igniter composition is formulated as a dry blend of fuel and oxidizer ingredients having a combustion temperature exceeding approximately 2500 K. Useful igniter composition fuels include B, Si, Al, Ti, $TiH_2$, Zr, $ZrH_2$, guanidine nitrate, Mg, Mg/Al alloys and mixtures thereof. Useful igniter composition oxidizers include alkali metal nitrates, chlorates and perchlorates; alkaline earth metal nitrates, chlorates and perchlorates; CuO; $Fe_2O_3$; CoO; $Co_3O_4$; $V_2O_5$; ammonium nitrate; ammonium perchlorate; basic copper nitrate and mixtures thereof. In practice, preferred igniter compositions for use in the practice of the invention contain about 15% to about 40% by weight of such fuels and about 60% to about 85% by weight of such oxidizers.

One group of particularly preferred igniter compositions for use in the practice of the invention constitutes a mixture of B, guanidine nitrate and potassium nitrate. In particular, igniter compositions containing up to about 20 weight percent guanidine nitrate, preferably about 10 weight percent guanidine nitrate, were found to be desirable in providing rapid ignition (e.g., reduced or minimized ignition delays) while resulting in increased gas outputs. Additionally, such inclusion of guanidine nitrate in the igniter compositions of the invention were found to generally result in igniter compositions of improved toughness, e.g., such compositions were generally not as easily undesirably removed or dislodged from an underlying gas generant particle. One such preferred igniter composition for use in the practice of the invention was composed of about 20.84% B, 10% guanidine nitrate, and 69.16% $KNO_3$.

Various techniques can, as desired, be employed to effect the coating the wet adhesive surface of the gas generant particles with the dry blend igniter composition. For example, such coating can involve one or more of: tumbling a plurality of the wet gas generant particles with a quantity of dry blend igniter composition powder; spray coating wet gas generant particles with a quantity of dry blend igniter composition powder, such as in a blender; and contacting a wet gas generant particle with a quantity of dry blend igniter composition powder during fluid bed drying of the particle. Thus, in accordance with the invention, a dry blend of the selected igniter composition can be applied to gas generant particles through the utilization of various simple application techniques.

As will be appreciated, when the igniter composition is applied to wet gas generant particles via such tumbling or spray coating, final drying of the prepared gas generant grain may be subsequently accomplished in a fluid bed drier or a standard convection oven, such as is known in the art.

The ignition enhanced gas generant grains of the invention typically are composed of about 75% by weight to about 97% by weight of the gas generant composition and about 3% by weight to about 25% by weight of the igniter.

Turning to the FIGURE, there is illustrated an airbag inflator assembly, generally designated by the reference numeral 10, which contains and utilizes a quantity of an ignition enhanced gas generant 12, in accordance with the subject invention. The gas generant 12 is composed of a quantity of generally tubular shaped or formed segments having or including a generally cylindrical bore.

The inflator assembly 10 comprises a pressure vessel 14 including a generally elongated cylindrical sleeve or tube 16. The sleeve 16 includes a plurality of gas exit orifices 20 therethrough such as to permit the passage of inflation gas from therein to an associated airbag cushion (not shown). The sleeve 16 has opposed first and second ends, 22 and 24, respectively. Each of the ends 22 and 24 is closed by means of an end wall, 26 and 30, respectively.

The pressure vessel 14 formed by the sleeve 16 and the end walls 26 and 30 forms a chamber 32. The end wall 26 includes an opening 34 therein, wherethrough an initiator device 36, such as is known in the art, is attached in sealing relation and such as to extend towards and into the chamber 32. The end wall 30 includes an outwardly extending mounting stud 40 such as is known in the art to facilitate desired attachment of the inflator assembly 10.

The chamber 32 contains a sealed generant canister 42 containing the quantity of an ignition enhanced gas generant 12. If desired, and as is shown, the canister may contain a multiple layer wrap of metal screen 44 or the like filter or cooling device to correspondingly treat the materials passing therethrough. As shown, such multiple layer wrap of metal screen 44 may desirably take the form of a cylindrical tube sleeve about the quantity of an ignition enhanced gas generant 12. In addition, as is shown and as may be desired, the canister may also include a vibration damper 46 such as to avoid or minimize the possibly undesired vibrational effect on the inflator assembly 10 when housed within a vehicle.

In operation, such as upon the sensing of a collision, an electrical signal is sent to the initiator device 36. The initiator device 36 functions to form or produce initiation reaction products which are directed or discharged at or into the generant canister 42 to interact with the quantity of an ignition enhanced gas generant 12, resulting in the ignition thereof The ignited enhanced gas generant reacts to produce quantities of inflation gas which are filtered or otherwise treated upon passage through the screen wrap 44 and resulting in the rupture of otherwise opening of the generant canister 42 in the vicinity of the gas exit orifices 20 such as to permit the passage of inflation gas through the orifices to an associated airbag cushion (not shown).

Thus, the invention provides an ignition enhanced gas generant grain and method of making thereof such as avoids the requirement or inclusion of a separate igniter composition charge in associated airbag inflator devices. Consequently, practice of the invention may beneficially reduce or minimize one or more of the cost, weight or complexity associated with one or more of the production, manufacture or use of such material and the devices in which such materials are used.

The present invention is described in further detail in connection with the following examples which illustrate or simulate various aspects involved in the practice of the invention. It is to be understood that all changes that come within the spirit of the invention are desired to be protected and thus the invention is not to be construed as limited by these examples.

EXAMPLES

Examples 1–10

The ingredients (Ing.) and the respective relative amounts (% by weight) for particular specific sample igniter compositions for use in the practice of the invention are identified in TABLE 1, below.

TABLE 1

| | Igniter Compositions | | | | | | | | | |
|---|---|---|---|---|---|---|---|---|---|---|
| | % by weight | | | | | | | | | |
| Ing. | 1 | 2 | 3 | 4 | 5 | 6 | 7 | 8 | 9 | 10 |
| B | 15.13 | — | 7.57 | 7.57 | — | — | 25.00 | — | — | — |
| Si | — | 18.63 | 9.32 | — | 9.27 | 12.03 | — | 28.85 | — | 21.64 |
| Mg | — | — | — | — | 24.07 | 12.50 | — | — | 41.24 | 10.31 |
| Al | — | — | — | 15.41 | — | — | — | — | — | — |
| CuO | — | — | — | — | — | 40.86 | — | — | — | — |
| $KNO_3$ | 84.87 | 81.37 | 83.11 | 77.02 | 66.66 | 34.61 | 75.00 | — | — | — |
| $KClO_4$ | — | — | — | — | — | — | — | 71.15 | 58.76 | 68.05 |

Example 11

A gas generant having the composition identified in TABLE 2, below, and containing a water soluble binder (guar gum), was extruded as a homogeneous mixture, with a water content of approximately 16.5% by weight, into the form of cylindrical perforated gas generant particles, e.g., the particles included a cylindrical bore such that the gas generant particle is generally tubular in shape or form. Each of the gas generant particles included a water wet adhesive surface coating of guar gum.

TABLE 2

| Gas Generant Composition | |
|---|---|
| Ingredient | % by weight |
| guar gum | 5.00 |
| hexammine cobalt (III) trinitrate | 73.5 |
| basic copper nitrate | 21.5 |

A dry granular igniter composition of B (25 weight %) and $KNO_3$ (75 weight %) was prepared and blended with the wet gas generant particles, with the igniter composition adhering to the surface of the gas generant particles to form ignition enhanced gas generant grains. The so formed grains were then dried to result in ignition enhanced gas generant grains wherein ignition material was strongly attached to a gas generant material.

Testing

Igniter testing has shown that in order to ignite the so formed gas generant composition of TABLE 2, ignition enhanced gas generant grains in accordance with the invention preferably contained about 5% by weight to about 10% by weight of such an igniter composition.

Inflator testing using a squib initiator in combination with the above-prepared ignition enhanced gas generant grains showed superior ignition characteristics as compared to an otherwise generally similar inflator wherein the squib initiator was used to ignite a separate igniter charge of a similar igniter composition to in turn ignite gas generant particles of a similar gas generant composition.

Such superior ignition characteristics were evidenced by the inflator with the above-prepared ignition enhanced gas generant grains experiencing significantly reduced ignition delays as compared to the generally similar inflator wherein the squib initiator was used to ignite a separate igniter charge of a similar igniter composition to in turn ignite gas generant particles of a similar gas generant composition.

Further, through the use of ignition enhanced gas generant grains in accordance with the invention, the total amount of igniter composition required was significantly reduced. For example, as compared to a comparable gas generant-containing gas output inflator which relies on a separate igniter charge to effect ignition of the gas generant, employing ignition enhanced gas generant grains in accordance with the invention reduced the amount of required igniter composition by up to about 30 percent or more. Thus, the use of ignition enhanced gas generant grains in accordance with the invention may also provide or result in significant cost benefits such as through a reduction in the amount or quantity of igniter composition needed or required to attain or achieve a selected level of inflation performance from an associated inflator device.

In view of the above, the invention provides a simplified processing technique whereby the requirement or inclusion of a separate igniter composition charge can be avoided. Further, the invention provides a processing technique and a gas generant which can provide greatly improved performance, such as through significantly reduced ignition delays, for example, as well as or alternatively, significant cost benefits, such as through reducing the amount of igniter composition required to provide a selected level of performance.

The invention illustratively disclosed herein suitably may be practiced in the absence of any element, part, step, component, or ingredient which is not specifically disclosed herein.

While in the foregoing detailed description this invention has been described in relation to certain preferred embodiments thereof, and many details have been set forth for purposes of illustration, it will be apparent to those skilled in the art that the invention is susceptible to additional embodiments and that certain of the details described herein can be varied considerably without departing from the basic principles of the invention.

What is claimed is:

1. A method of making an ignition enhanced gas generant, said method comprising:

applying a dry blend igniter composition to a gas generant particle to form an ignition enhanced gas generant grain, wherein the gas generant particle has a wet adhesive surface.

2. The method of claim 1 additionally comprising the step of:

solvent extruding a gas generant material to form the gas generant particle, the particle having a solvent wet adhesive surface to which the dry blend igniter composition is applied.

3. The method of claim 1 wherein the gas generant particle includes a solvent soluble binder, which binder forms the wet adhesive surface.

4. The method of claim 1 additionally comprising the step of:

forming the gas generant particle having a wet adhesive surface in a preselected shape prior to said step of applying the dry blend igniter composition.

5. The method of claim 1 wherein said applying step comprises the step of coating the wet adhesive surface of the gas generant particle with the dry blend igniter composition.

6. The method of claim 5 wherein said coating step comprises tumbling a plurality of the wet gas generant particles with a quantity of dry blend igniter composition powder.

7. The method of claim 5 wherein said coating step comprises spray coating a wet gas generant particle with a quantity of dry blend igniter composition powder.

8. The method of claim 5 wherein said coating step comprises contacting a wet gas generant particle with a quantity of dry blend igniter composition powder during fluid bed drying of the particle.

* * * * *